United States Patent [19]

Fendley

[11] Patent Number: 4,695,761

[45] Date of Patent: Sep. 22, 1987

[54] TENSION SHADOW MASK SUPPORT STRUCTURE

[75] Inventor: James R. Fendley, Arlington Heights, Ill.

[73] Assignee: Zenith Electronics Corporation, Glenview, Ill.

[21] Appl. No.: 832,556

[22] Filed: Feb. 21, 1986

[51] Int. Cl.[4] ..... H01J 29/07

[52] U.S. Cl. ..... 313/407; 313/408; 313/286

[58] Field of Search ..... 313/407, 482, 408, 403, 313/269, 286, 284

[56] References Cited

U.S. PATENT DOCUMENTS

| | | | |
|---|---|---|---|
| 2,625,734 | 1/1953 | Law | 29/25.13 |
| 2,842,696 | 7/1958 | Fischer-Colbrie | 313/78 |
| 2,905,845 | 9/1959 | Vincent | 313/78 |
| 3,030,536 | 4/1962 | Hackett et al. | 313/80 |
| 3,284,655 | 11/1966 | Oess | 313/286 |
| 3,638,063 | 1/1972 | Tachikawa et al. | 313/348 |
| 3,727,087 | 4/1973 | Steinberg et al. . | |
| 3,894,321 | 7/1975 | Moore | 29/25.15 |
| 4,045,701 | 8/1977 | Dougherty | 313/408 |
| 4,072,876 | 2/1978 | Morrell | 313/403 |
| 4,495,437 | 1/1985 | Kume et al. | 313/407 X |
| 4,547,695 | 10/1985 | Rath | 313/407 X |
| 4,547,696 | 10/1985 | Strauss | 313/407 |
| 4,595,857 | 6/1986 | Rowe et al. | 313/407 |
| 4,605,879 | 8/1986 | Rath | 313/407 |

OTHER PUBLICATIONS

Journal Article, "The CBS Colortron: A Color Picture Tube of Advanced Design", Fyler et al. Proc. of the Ire, Jan. 1954, Dec. Class R583.6.

"A High Brightness Shadow-Mask Color CRT For Cockpit Displays"; SID 83 Digest; Robinder et al.

*Primary Examiner*—Palmer C. DeMeo

*Attorney, Agent, or Firm*—Ralph E. Clarke, Jr.

[57] ABSTRACT

A front assembly for a color cathode ray tube includes a faceplate having on its inner surface a centrally disposed phosphor screen. The assembly according to the invention comprises in one embodiment a shadow mask support structure composed of sheet metal secured to the inner surface of the faceplate on opposed sides of the screen, and a foil shadow mask secured in tension on the structure. Other embodiments of the invention comprise shadow mask support structures having in cross-section the shape of an inverted "V", and the shapes of a a hollow tube, a rectangle, and a tooth.

12 Claims, 10 Drawing Figures

TENSION SHADOW MASK SUPPORT STRUCTURE

CROSS-REFERENCE TO RELATED APPLICATIONS AND PATENTS

This application is related to but in no way dependent upon copending applications Ser. No. 538,001 filed Sept. 30, 1983 now U.S. Pat. No. 4,593,224; Ser. No. 538,003 filed Sept. 30, 1983; Ser. No. 572,088 filed Jan. 8, 1984, now U.S. Pat. No. 4,547,696; Ser. No. 572,089 filed Jan. 18, 1984; Ser. No. 725,040 filed Apr. 19, 1985; Ser. No. 729,015 filed May 17, 1985; Ser. No. 758,174 filed July 23, 1985; Ser. No. 727,486 filed Apr. 26, 1985; Ser. Nos. 754,786 and 754,787 both filed July 12, 1985; Ser. No. 831,697 filed Feb. 21, 1986 Ser. No. 832,559 filed Feb. 21, 1986 Ser. No. 832,493 filed Feb. 21, 1986 Ser. No. 835,845 filed Mar. 3, 1986; and Ser. No. 836,696 filed Feb. 21, 1986, all of common ownership herewith.

BACKGROUND OF THE INVENTION

This invention relates to color cathode ray picture tubes and is addressed specifically to an improved front assembly for color tubes having shadow masks of the tension foil type in association with a substantially flat faceplate. The invention is useful in color tubes of various types including those used in home entertainment television receivers, and those used in medium-resolution and high-resolution tubes intended for color monitors.

The use of the tension foil mask and flat faceplate provides many advantages and benefits in comparison to the conventional domed shadow mask. Chief among these is a greater power-handling capability which makes possible as much as a three-fold increase in brightness. The conventional curved shadow mask, which is not under tension, tends to "dome" in picture areas of high-brightness where the intensity of the electron beam bombardment is greatest. Color impurities result as the mask moves closer to the faceplate. As it is under high tension, the tension foil mask does not dome or otherwise move in relation to the faceplate, hence its greater brightness potential while maintaining color purity.

The tension foil shadow mask is a part of the cathode ray tube front assembly, and is located in close adjacency to the faceplate. The front assembly comprises the faceplate with its deposits of light-emitting phosphors, a shadow mask, and support means for the mask. As used herein, the term "shadow mask" means an apertured metallic foil which may, by way of example, be about one mil thick, or less. The mask must be supported in high tension a predetermined distance from the inner surface of the cathode ray tube faceplate; this distance is known as the "Q-distance." The high tension is a tension in the range of 20 to 40 kpsi. As is well known in the art, the shadow mask acts as a color-selection electrode, or parallax barrier, which ensures that each of the three beams lands only on its assigned phosphor deposits.

The requirements for the support means for the shadow mask are stringent. As has been noted, the shadow mask must be mounted under high tension. The support means must be of high strength so the mask is held immovable—an inward movement of the mask of as little as one-tenth of a mil is significant in expending guard band. Also, the shadow mask support means must be of such configuration and material composition as to be compatible with the means to which it is attached. As an example, if the support means is attached to glass, such as the glass of the inner surface of the faceplate, the support means must have substantially the same thermal coefficient of expansion as the glass. Further, the support means must provide a suitable surface for mounting and securing the mask. Also, the support means must be of such composition that the mask can be secured to it by electrical resistance welding or laser welding. The support surface must also be of such flatness that no voids between the metal of the mask and the support structure can exist to prevent the positive metal-to-metal contact required for proper welding.

A tension mask registration and supporting system is disclosed by Strauss in U.S. Pat. No. 4,547,696 of common ownership herewith. A frame dimensioned to enclose the screen comprises first and second spaced-apart surfaces. A tensed foil shadow mask has a peripheral portion bonded to a second surface of the frame. The frame is registered with the faceplate by ball-and-groove indexing means. The shadow mask is sandwiched between the frame and a stabilizing or stiffening member. When the system is assembled, the frame is located between the sealing lands of the faceplate and a funnel, with the stiffening member projecting from the frame into the funnel. While the system is feasible and provides an effective means for holding a mask under high tension and rigidly planoparallel with the flat faceplate, weight is added to the cathode ray tube, and additional process steps are required in manufacture.

There exists in the marketplace today a color tube which utilizes a tensed shadow mask. The mask is understood to be placed under high tension by purely mechanical means. Specifically, a very heavy mask support frame is compressed prior to and during affixation of the mask to it. Upon release of the frame, restorative forces in the frame cause the mask to be placed under high residual tension. During normal tube operation, electron beam bombardment causes the mask to heat up and the mask tension to be reduced. An upper limit is placed on the intensity of the electron beams which may be used to bombard the screen without causing the mask to relax completely and lose its color selection capability. The upper limit has been found to be below that required to produce color pictures of the same brightness as are produced in tubes having non-tensed shadow masks. For descriptions of examples of this type of tube, see U.S. Pat. No. 3,683,063 to Tachikawa et al.

| | | | |
|---|---|---|---|
| 2,625,734 | Law | 3,284,655 | Oess |
| 2,842,696 | Fischer-Colbrie | 3,894,321 | Moore |
| 2,905,845 | Vincent | 3,727,087 | Steinberg et al |
| 3,030,536 | Hackett et al | 4,045,701 | Dougherty |

Digest article: "A High-Brightness Shadow-Mask Color CRT for Cockpit Displays." Robinder et al. Society for Information Display, 1983.

Journal article: "The CBS Colortron: A Color Picture Tube of Advanced Design." Fyler et al. Proc. of the IRE, Jan. 1954.

Objects of the Invention

It is a general object of the invention to provide an improved front assembly for cathode ray tubes that utilize the tension foil shadow mask, It is another general object of the invention to provide a tension foil shadow mask support structure that is low in cost and light in weight.

It is an object of the invention to provide a tension foil shadow mask support structure that can be mounted on a faceplate for receiving a tension foil shadow mask.

It is a further object of the invention to provide a tension foil shadow mask support structure that is capable of holding a tension foil shadow mask firmly in registration under high electron beam bombardment.

It is yet another object of the invention to provide a tension foil shadow mask support structure that simplifies manufacture and lowers manufacturing costs.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

DESCRIPTION OF THE PREFERRED EMBODIMENTS

Figure 1:
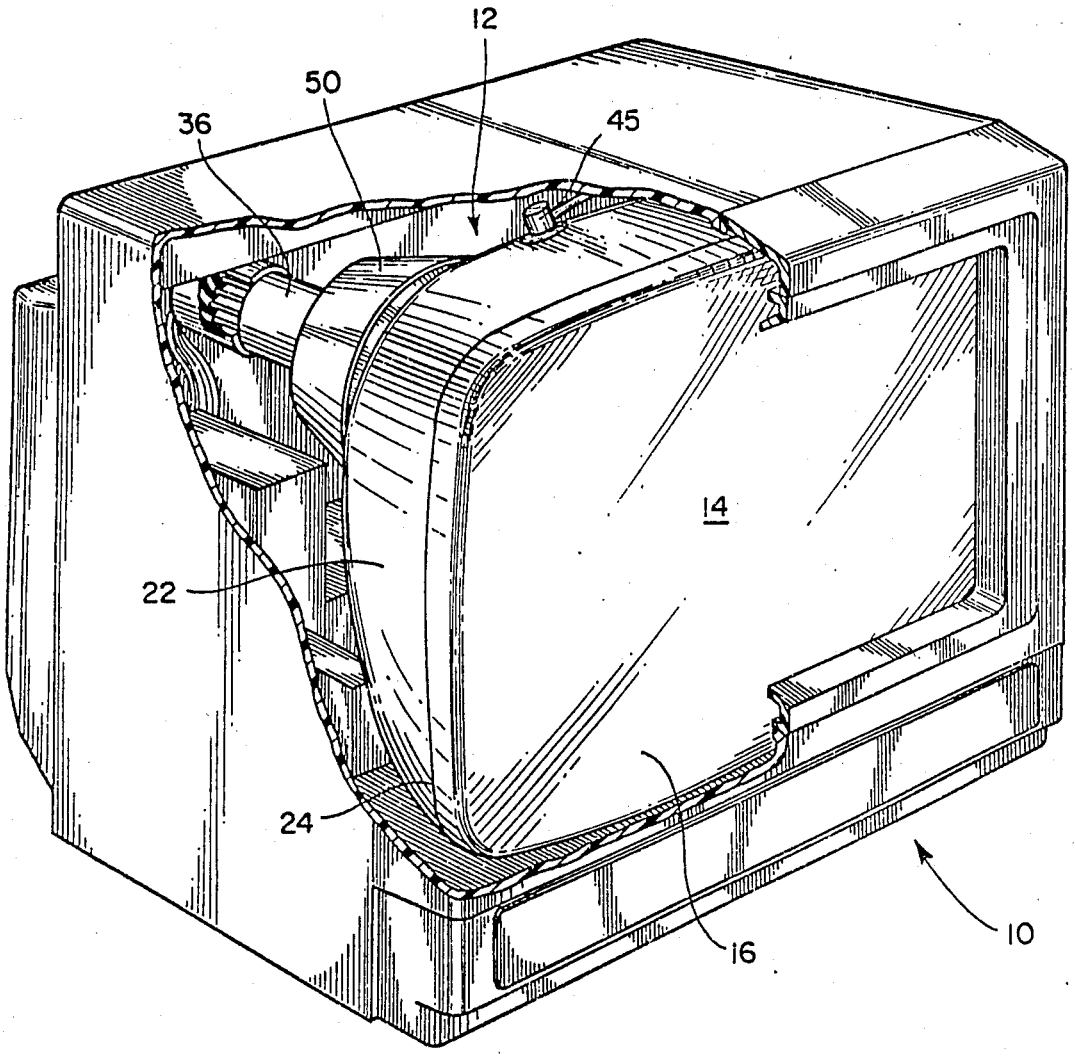
FIG. 1 is a cut-away view in perspective of a cabinet that houses a cathode ray tube having a improved front assembly according to the invention, and showing major components relevant to the disclosure.

With reference to FIG. 1, there is shown a video monitor 10 that houses a color cathode ray tube 12 having a front assembly with an improved shadow mask support structure according to the invention. The design of the video monitor is the subject of copending design patent application Ser. No. 725,040, of common ownership herewith. The tube having a front assembly according to the invention could as well be contained in a television console of the home entertainment type. The tube 12 shown is notable for the substantially flat imaging area 14 that makes possible the display of images in undistorted form. Imaging area 14 also offers a more efficient use of the screen area as the corners are relatively square in comparison with the more rounded corners of the present-day home entertainment cathode ray tube. The novel cathode ray tube front assembly and its improved shadow mask support structure according to the invention comprise the components described in the following paragraphs.

Figure 2:
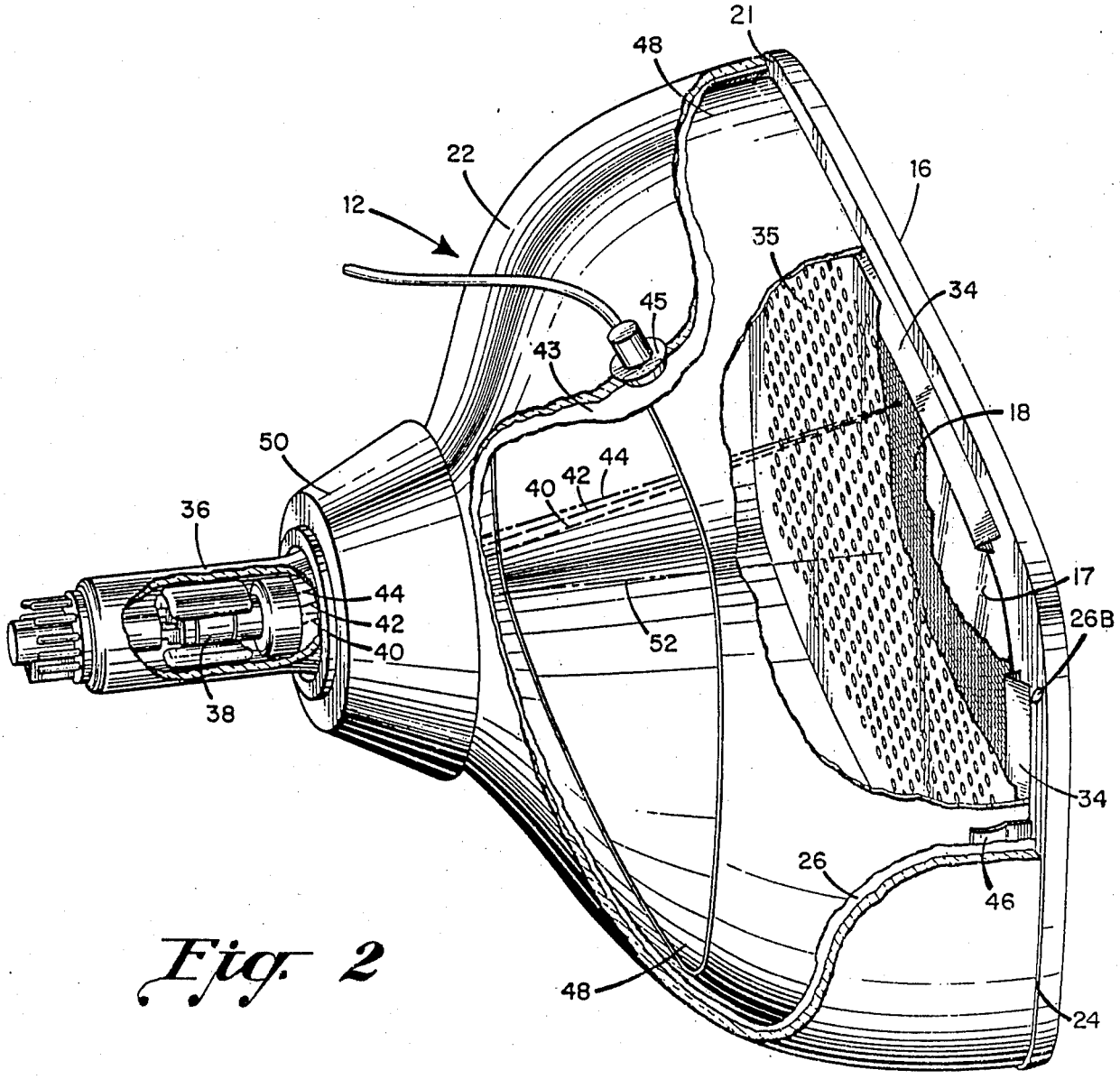
FIG. 2 is a side view in perspective of the color cathode ray tube of FIG. 1 showing another view of the components depicted in FIG. 1 together with cut-away sections that indicate the location and features of an improved tension foil shadow mask support structure according to the invention.
Figure 2A:
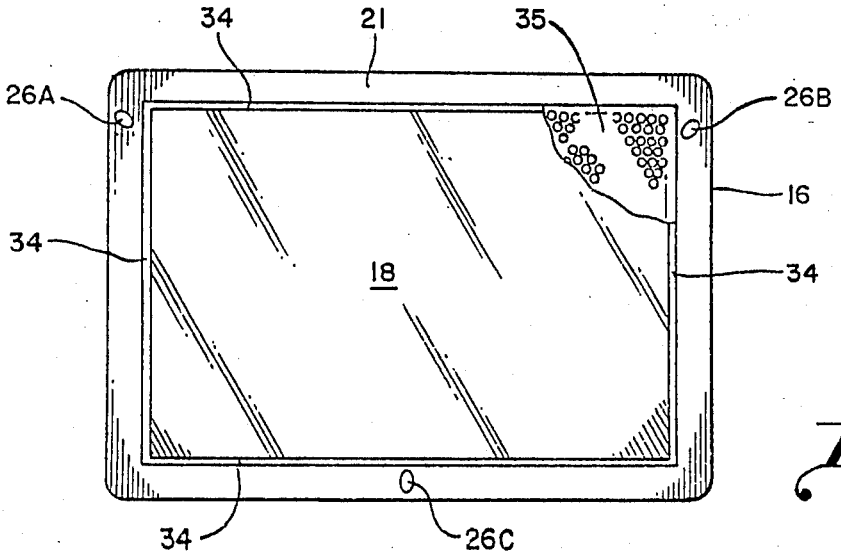
FIG. 2A is a plan view showing the relationship of the improved shadow mask support structure to the inner surface of the cathode ray tube faceplate shown by FIG. 2.
Figure 3:
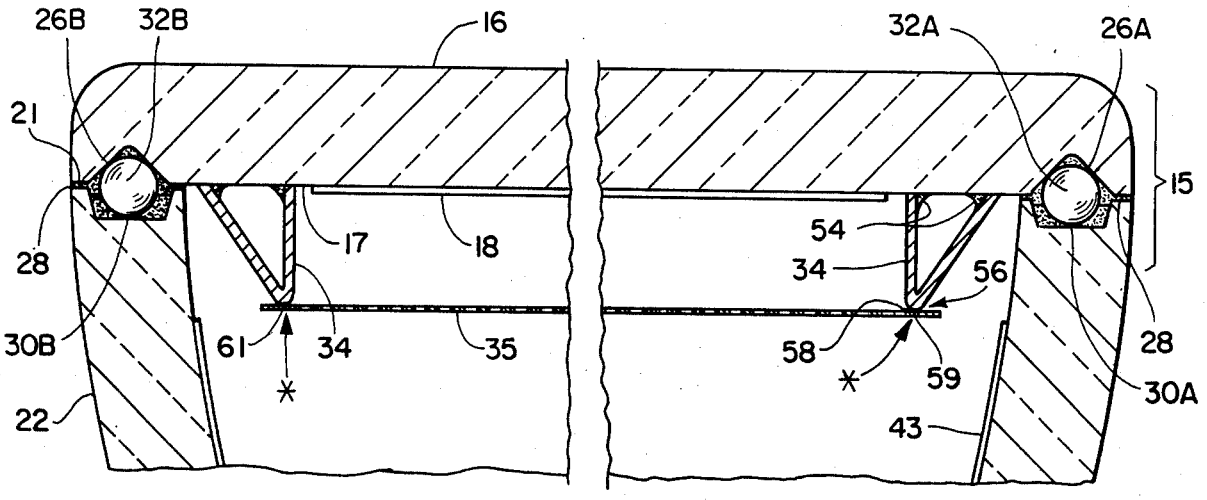
FIG. 3 is a view in elevation of a section of the front assembly and associated tube funnel, and showing a preferred embodiment of the improved shadow mask support structure according to the invention.

With reference also to FIGS. 2, 2A and 3, a front assembly 15 according to the invention for a color cathode ray tube is depicted. The front assembly 15 includes a glass faceplate 16 noted as being flat, or alternately, "substantially flat," in that it may have finite horizontal and vertical radii, for example. Faceplate 16, depicted as being flangeless, is indicated as having on its inner surface 17 a centrally disposed phosphor screen 18 on which is deposited on electrically conductive film (not indicated), typically composed of aluminum. The phosphor screen 18 and the conductive film comprise the electron beam target area.

Screen 18 is shown as being surrounded by a peripheral scaling area 21 adapted to be mated with a funnel 22. Sealing area 21 has, by way of example, three cavities: 26A, 26B and 26C therein. The cavities provide, in conjunction with complementary rounded indexing means, for indexing faceplate 16 with funnel 22, as will be shown.

Funnel 22 has a funnel-sealing area 28 with second indexing elements 30A, 30B and 30C therein in orientation alike to indexing elements 26A, 26B and 26C; indexing elements 30A and 30B are depicted in FIG. 3 as being V-grooves in facing adjacency with the cavities 26A and 26B. (Indexing elements 30C and 26C are similarly located.) The V-grooves of indexing elements 30A, 30B and 30C are preferably radially oriented, and the indexing elements are preferably located at 120 degree intervals in the funnel-sealing area 28. Ball means 32A, 32B and 32C, which provide the aforedescribed complementary rounded indexing means, are conjugate with the indexing elements 26A, 26B and 26C, and 32A, 32B and 32C for registering faceplate 16 and funnel 22. The indexing means set forth in the foregoing and their application to the foil tension mask technology is described and claimed in referent copending applications Ser. Nos. 572,088, 572,089, 727,486; 729,015; 754,786; 754,787; 758,174; 831,697 and in U.S. Pat. No. 4,547,696 to Strauss, all of common ownership herewith.

Front assembly 15 according to the invention includes a tension foil shadow mask support structure 34, noted as being in the form of a frame of improved configuration and composition, secured to the inner surface 17 of faceplate 16 between the centrally disposed screen 18 and the peripheral sealing area 21 of faceplate 16, and enclosing screen 18. The shadow mask support structure 34 according to the invention is preferably composed of sheet metal, and is secured to the inner surface 17 on opposed sides of screen 18, as indicated by FIG. 2A. A foil shadow mask 35 is secured in tension on structure 34 according to the invention.

A neck 36 extending from funnel 22 is represented as enclosing an electron gun 38 which is portrayed as emitting three electron beams 40, 42 and 44. The three beams serve to selectively excite to luminescense the phosphor deposits on the screen 18 after passing through the parallax barrier formed by shadow mask 35.

Funnel 22 is indicated as having an internal electrically conductive funnel coating 43 adapted to receive a high electrical potential. The potential is depicted as being applied through an anode button 45 attached to a conductor 47 which conducts a high electrical potential to the anode button 45, which projects through the wall of funnel 22. The source of the potential is a high-voltage power supply (not shown). The potential may be, for example, in the range of 18 to 30 kilovolts, depending upon the type and size of cathode ray tube. Means for providing an electrical connection between the sheet metal frame 34 and the funnel coating 43 may comprise spring means 46, as depicted in FIG. 2. An internal magnetic shield 48 provides shielding for the electron beam excursion area and the front assembly 15 from the influence of stray magnetic fields. A yoke 50 is shown as encircling tube 12 in the region of the junction between funnel 22 and neck 36. Yoke 50 provides for the electromagnetic scanning of beams 40, 42 and 44 across the screen 18. The center axis 52 of tube 12 is indicated by the broken line. Items designated as "radially extending" extend radially outwardly from this axis.

FIG. 3 provides a more detailed view of an embodiment of the shadow mask support structure 34 according to the invention as it relates to the faceplate 16, the inner surface 17 of faceplate 16, the centrally disposed screen 18, the peripheral sealing area 21 of the faceplate 16, and a foil shadow mask 35. Support structure 34 is indicated as being secured to the inner surface 17 by means of a cement 54 which may comprise by way of example a devitrifying glass frit such as that supplied by Owens-Illinois under the designation CV-130. Alternately, the cement 54 may comprise a cold-setting cement of the type supplied by Sauereisen Cements Company of Pittsburgh, Pa.

This embodiment of the support structure 34, noted as being made of sheet metal, is depicted as having a peak 56 with a first surface 58 for receiving foil shadow mask 35 in tension; the preferred composition of the support structure is metal such as Carpenter Alloy No. 27 manufactured by Carpenter Technology, Inc. of Reading, Pa. (As used herein, the term "peak" means the promontory of a shadow mask supporting structure for receiving a foil shadow mask.) First surface 58 preferably has a flat surface 59 for receiving and securing the foil shadow mask 35 in tension. The thickness of the alloy No. 27 may be in the range of 10 to 20 mils, by way of example.

The preferred method of installing the mask is to stretch a pre-apertured shadow mask blank across the tension mask supporting structure 34 by tensioning means. Suitable mask installation and tensioning means are fully described and claimed in referent copending application Ser. No. 831,696 of common ownership herewith. The mask is stretched across supporting structure 34 and is secured to structure 34 by welding. The welding process may be electrical resistance welding or laser welding. In the 14-inch tube, as many as 1,000 such welds, preferably at intervals of about 0.040 inch around the circumference of the supporting structure 34, are recommended to ensure positive securement of the mask 35. Also, it is considered necessary that the peak 56 have the flat surface 59 for ensuring positive all-around welded contact between the mask 35 and the supporting structure 34. The flat surface may be created by lapping; that is, by rubbing the surface of the supporting structure (when mounted on the faceplate) against a flat surface having an abrasive thereon. The breadth of the flat surface 59 can be in the range of 5 to 100 mils according to the invention for securing a foil mask in tension. After the mask has been tensed and secured to the supporting frame 34, excess mask material is trimmed off, as indicated by trim line 61.

Figure 3A:
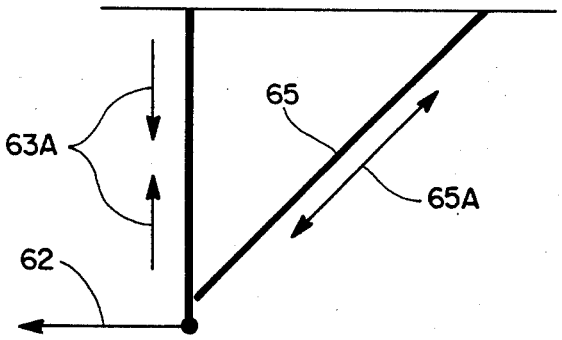
FIG. 3A is stick figure representation portraying diagrammatically the forces of tension and compression inherent in the FIG. 3 embodiment.

Referring to FIG. 3A, it will be recognized that the essence of the supporting structure 34 of the FIG. 3 embodiment is a compression member 63 which defines the mask-to-screen distance, and a tension member 65 which resists the high restorative forces developed in the tension foil shadow mask by the aforedescribed tensioning; the direction of these forces is represented by the arrow 62. The compressive and tensive aspects are indicated by the respective arrows 63A and 65A.

Figure 4:
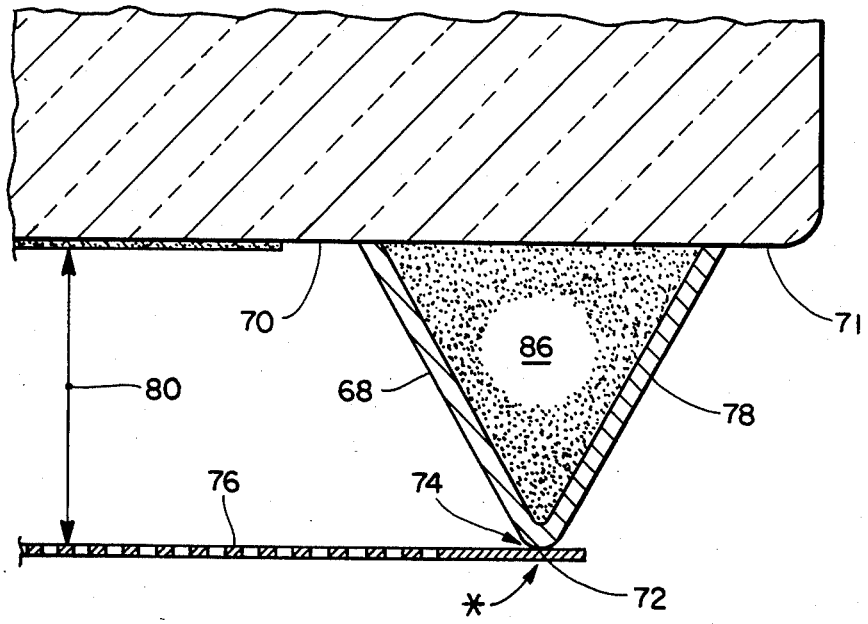
FIGS. 4 and 5 are detail views in elevation of further embodiments of the improved shadow mask support structure according to the invention.

Another aspect of the preferred embodiment of the invention is depicted in FIG. 4, in which a faceplate 66 is shown as having a foil shadow mask support structure 68 composed of sheet metal secured to the inner surface 70 of faceplate 66. Support structure 68 is depicted in this aspect of the invention as having a cross-sectional configuration approximating an inverted "V". The peak 72 of support structure 68 provides a first surface 74 for receiving a foil shadow mask 76 in tension. A second surface 78 is represented as extending radially outwardly and sloping downwardly from peak 72. The second surface 78 will be noted as being closer to the faceplate inner surface 68 than first surface 74 such that peak 72 precisely defines a predetermined mask-to-screen Q-distance 80. Mask 76 is depicted as being secured to the peak 72 of support structure 68, as indicated by the weld symbol. Support structure 68, noted as being sheet metal in this embodiment of the invention, can be fabricated by roll-forming or extrusion, by way of examples.

A further aspect of a preferred embodiment of the invention is also depicted in FIG. 4 wherein the shadow mask supporting structure 68 is indicated as being hollow. Supporting structure 68 is depicted as having, according to the invention, a hardened cement 86 within. Cement 86 is effective upon hardening to attach shadow mask supporting structure 68 to the inner surface 70 of faceplate 66. The beneficial effect of the cement is to strengthen, in accordance with the invention, supporting structure 68 against deflection resulting from the high tension of the shadow mask 76, and to firmly secure the supporting structure 68 to the inner surface 70 of faceplate 66. The enclosing of the cement within the supporting structure has another benefit in that the securement means for the supporting structure does not intrude upon the areas of the peripheral sealing area 71 of the faceplate nor its inner surface 70. It is essential in the installation of the cement 86 that there be no voids in the cement as process screening 86 that there be no voids in the cement as process screening fluids could otherwise be retained therein to emerge later as contaiminants in the production process.

Figure 5:
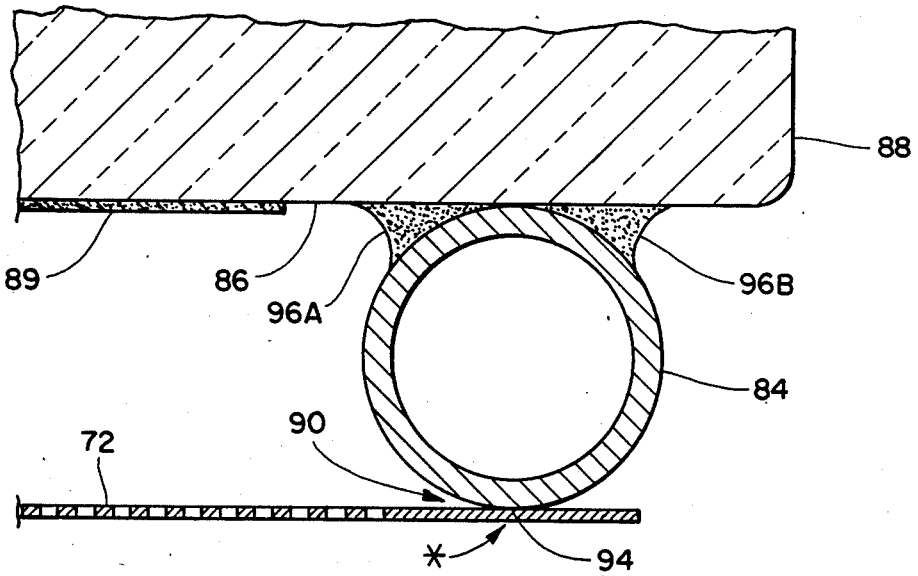

Another embodiment of the shadow mask support is shown by FIG. 5, which depicts a shadow mask support structure 84 depicted as having in cross-section the shape of a hollow tube. The structure 84 is secured to the inner surface 86 of a faceplate 88 on opposed sides of the screen 89. Support structure 84 is depicted as having a peak 90 for receiving and securing a shadow mask 92 in tension. Peak 90 may have a flat surface 94 like the flat surface 59 described in connection with the embodiment of the invention shown by FIGS. 3 and 3A. Support structure 84 is indicated as being secured to the inner surface 86 of faceplate 88 by fillets 96A and 96B of cement, which may be by way of example, a devitrifying frit.

Figure 6:
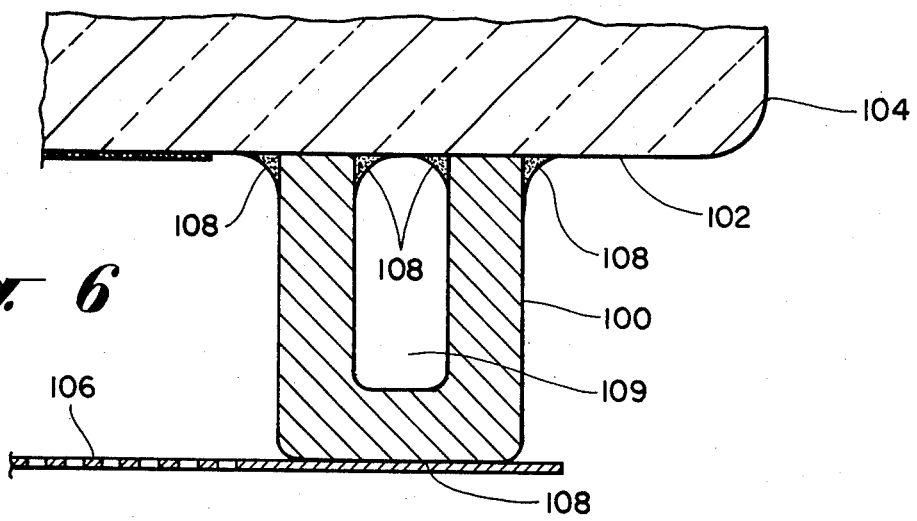
FIG. 6 is a detail view in elevation showing another embodiment of the invention.

While particular embodiments of the invention have been shown and described, it will be readily apparent to those skilled in the art that changes and modifications, as well as other embodiments of the shadow mask support structure, may be made without departing from the invention in its broader aspects. For example, the shadow mask support structure according to the invention may comprises the embodiments shown by FIGS. 6, 6A and 7. A shadow mask support structure 100 is depicted in FIG. 6 as being secured to the inner surface 102 of a faceplate 104 for supporting a shadow mask 106 on mask-receiving surface 108. Support structure 100 is shown as being attached to inner surface 102 by fillets of cement 110 which may comprise a devitrifying glass frit or a cold-setting cement, as heretofore described. The hollow interior 109 of mask support structure 100 could as well be completely filled with cement, as represented by mask-support structure 68 depicted in FIG. 4.

Figure 6A:
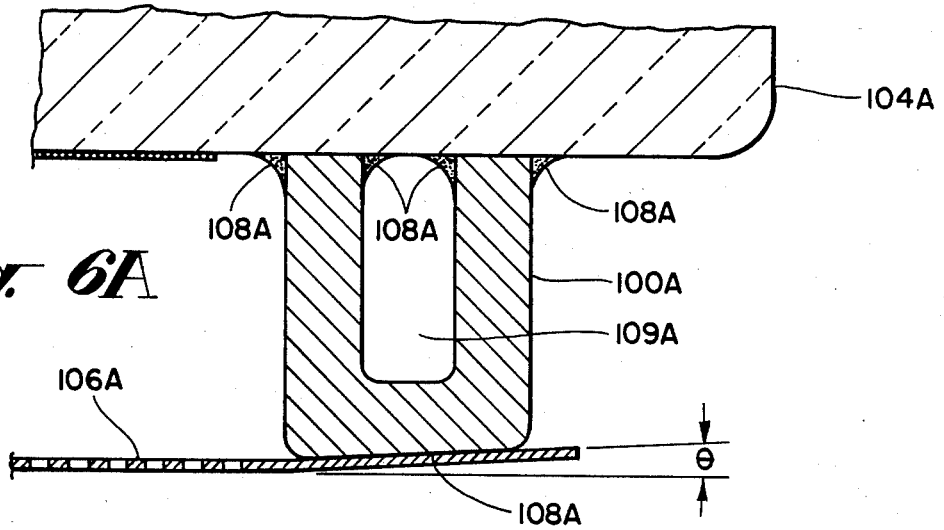
FIG. 6A depicts as variation in the FIG. 6 configuration.
Figure 7:
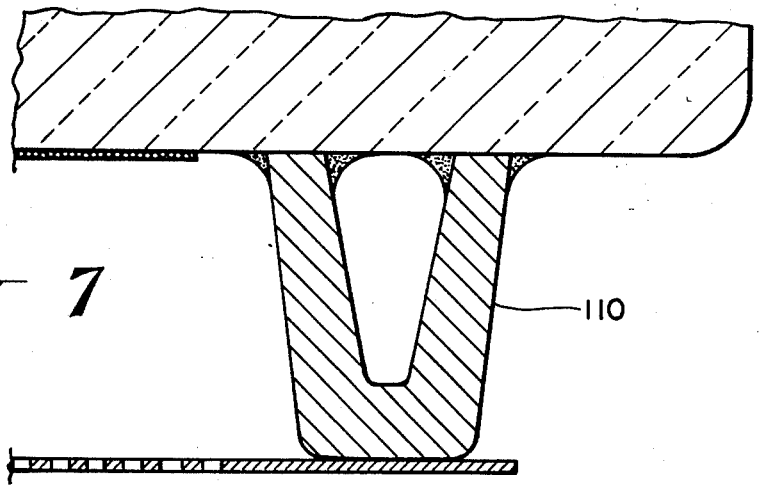
FIG. 7 is a view similar to FIG. 6 showing yet another embodiment of the invention.

Another configurative aspect of the FIG. 6 embodiment of the invention is shown by FIG. 6A wherein the mask-receiving surface 108A of support structure 100A is depicted as being at an angle $\theta$ with respect to the plane of the mask. A further embodiment is shown by FIG. 7 wherein a mask-support structure 110 is depicted as having a tooth-like configuration.

The various configurations of the shadow mask support structures according to the invention can be formed by various means. For example, the structures can be fabricated by roll-forming, which is a continuous high-production process for shaping metal strips by means of progressive forming rolls—a method notable for accuracy in formation and production economies. Another feasible manufacturing techniques is cold-extruding, also known as impact extruding or cold forgoing, which provides close tolerance and excellent surface finishes. Casting and powder metallurgy are still other feasible fabrication techniques.

The aim of the appended claims is to cover all such changes and modifications as fall within the true spirit and scope of the invention.

We claim

1. A front assembly for a color cathode ray tube including a faceplate having on its inner surface a centrally disposed phosphor screen, said assembly including a shadow mask support structure composed of sheet metal secured directly to said inner surface and extending along opposed sides of said screen, and a foil shadow mask secured in tension on said structure, the mechanical rigidity of said faceplate imparted to said support structure counteracting the tension in said mask.

2. A front assembly for a color cathode ray tube including a faceplate having on its inner surface a centrally disposed phosphor screen, said assembly including a shadow mask support structure composed of sheet metal secured directly to said inner surface and extending along opposed sides of said screen, said sheet metal support structure having a peak for receiving and securing a foil shadow mask in tension, the mechanical rigidity of said faceplate imparted to said support structure conteracting the tension in said mask.

3. The front assembly according to claim 2 wherein said peak has a flat surface thereon with a breadth of from 5 to 100 mils for receiving and securing said shadow mask in tension.

4. A front assembly for a color cathode ray tube including a faceplate having on its inner surface a centrally disposed phosphor screen, said assembly including a shadow mask support structure composed of sheet metal secured to said inner surface on opposed sides of said screen, said sheet metal support structure having a peak with a flat surface, said surface having a breadth in the range of 5 to 100 mils for receiving and securing a foil shadow mask in tension, and a second surface extending radially outwardly and closer to the faceplate inner surface than said peak such that said peak precisely defines a predetermined mask-to-screen Q-distance.

5. A front assembly for a color cathode ray tube including a faceplate having on its inner surface a centrally disposed phosphor screen, said assembly including a hollow metal shadow mask support structure secured directly to said inner surface and extending along opposed sides of said screen to which is secured in tension a foil shadow mask, the mechanical rigidity of said faceplate imparted to said support structure counteracting the tension in said mask.

6. A front assembly for a color cathode ray tube having a faceplate with a centrally disposed phosphor screen, said assembly including a foil shadow mask support structure composed of sheet metal secured to said inner surface on opposed sides of said screen, said structure having a cross-sectional configuration approximating an inverted "V", the peak of which provides a surface for receiving and securing a foil shadow mask in tension.

7. A front assembly for a color cathode ray tube having a faceplate with a centrally disposed phosphor screen, said assembly including a foil shadow mask support structure composed of sheet metal secured to said inner surface on opposed sides of said screen, said structure having a cross-sectional configuration approximating an inverted "V", the peak of which provides a first surface for receiving a foil shadow mask in tension, and a second surface extending radially outwardly and sloping downwardly from said peak, said second surface being closer to the faceplate inner surface than said first surface such that said peak precisely defines a predetermined mask-to-screen Q-distance.

8. A front assembly for a color cathode ray tube including a faceplate having on its inner surface a centrally disposed phosphor screen, said assembly including a hollow shadow mask supporting structure of metal composition having a peaked cross-section surrounding said screen and secured on opposed sides of said screen to said inner surface for receiving and securing in high tension a foil shadow mask, said hollow in said structure having a hardened cement within, said cement being effective to attach said structure to said faceplate and to strengthen said structure against deflection resulting from said high tension of said mask.

9. A front assembly for a color cathode ray tube including a faceplate having on its inner surface a centrally disposed phosphor screen, said assembly having a sheet metal shadow mask support structure secured to said inner surface and on opposed sides of said screen, said structure having a compressive member for supporting and securing said mask at a predetermined Q-distance from said screen, and a tensive member located radially outwardly from said compressive member for resisting the high restorative forces developed in said mask.

10. The support structure according to claim 9 wherein said tensive member is a discrete structure for supporting said compressive member.

11. The support structure according to claim 9 wherein said tensive member is a unitary extension of said compressive member.

12. A front assembly for a color cathode ray tube including a faceplate having on its inner surface a centrally disposed phosphor screen, said assembly including a shadow mask support structure having in cross-section the shape of a hollow metal tube secured directly to said inner surface and extending along opposed sides of said screen, said support structure having a peak for receiving and securing a foil shadow mask in tension, the mechanical ragidity of said faceplate imparted to said support structure conteracting the tension in said mask.

* * * * *